US006039032A

United States Patent [19]

Morikawa et al.

[11] Patent Number: 6,039,032

[45] Date of Patent: Mar. 21, 2000

[54] AIR-FUEL RATIO CONTROLLER FOR AN INTERNAL COMBUSTION ENGINE

[75] Inventors: Junya Morikawa, Toyota; Makoto Miwa, Kariya, both of Japan

[73] Assignee: Denso Corporation, Kariya, Japan

[21] Appl. No.: 09/081,790

[22] Filed: May 20, 1998

[30] Foreign Application Priority Data

May 22, 1997 [JP] Japan ..... 9-131806

[51] Int. Cl.[7] ..... F02M 37/04

[52] U.S. Cl. ..... 123/520; 123/698

[58] Field of Search ..... 123/518, 519, 123/520, 679, 698

[56] References Cited

U.S. PATENT DOCUMENTS

| | | | |
|---|---|---|---|
| 5,363,830 | 11/1994 | Morikawa . | |
| 5,520,160 | 5/1996 | Aota et al. . | |
| 5,529,047 | 6/1996 | Aota et al. . | |
| 5,727,537 | 3/1998 | Nakagawa et al. | 123/698 |
| 5,735,255 | 4/1998 | Farmer et al. | 123/698 |
| 5,791,321 | 8/1998 | Kondoh | 123/520 |
| 5,806,507 | 9/1998 | Osanai | 123/698 |

FOREIGN PATENT DOCUMENTS

| | | |
|---|---|---|
| 7-83096 | 3/1995 | Japan . |
| 7-166981 | 6/1995 | Japan . |

*Primary Examiner*—Thomas N. Moulis
*Attorney, Agent, or Firm*—Nixon & Vanderhye P.C.

[57] ABSTRACT

An air/fuel ratio controller for an internal combustion engine that obtains stabilized air-fuel ratio controllability even when an air-fuel ratio is changed during purge execution. In purge control to discharge fuel vapor adsorbed in a canister to an intake-air side of an internal combustion engine, the controller controls a purge ratio, by controlling operation of the purge solenoid valve, even when an air-fuel ratio is changed. A fuel-injection quantity from an injector is then compensated in correspondence thereto. Thus, stabilized air-fuel ratio controllability can be obtained by correction with a fuel-injection quantity, or purge correction by a control duty of the purge solenoid valve as a purge control parameter, even when an air-fuel ratio λ is changed during purge execution, taking a predetermined ratio as the purge ratio.

23 Claims, 9 Drawing Sheets

FIG. 6A
FIG. 6B
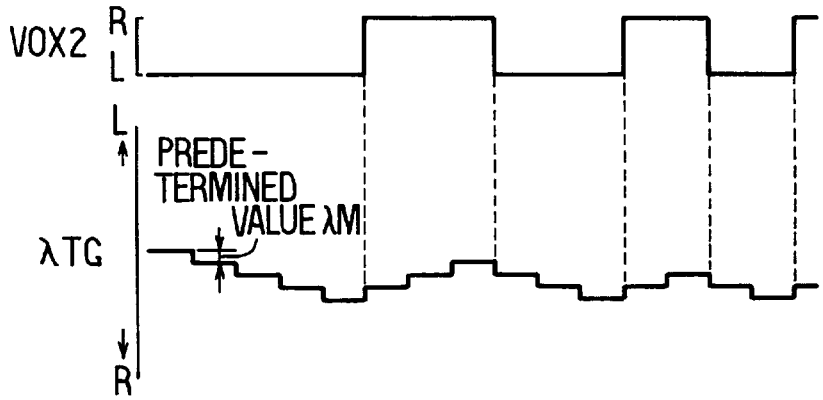
FIG. 7
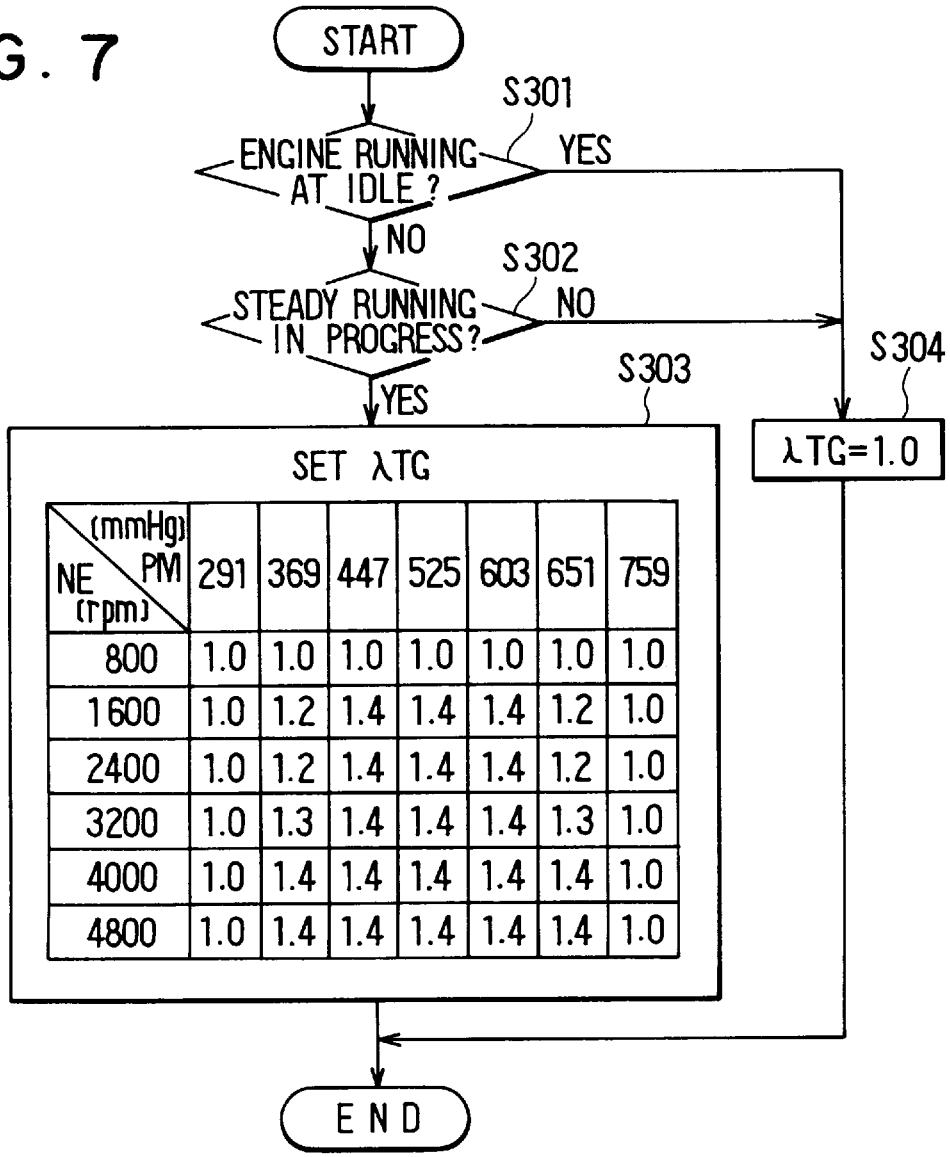
| NE (rpm) \ PM (mmHg) | 291 | 369 | 447 | 525 | 603 | 651 | 759 |
|---|---|---|---|---|---|---|---|
| 800 | 1.0 | 1.0 | 1.0 | 1.0 | 1.0 | 1.0 | 1.0 |
| 1600 | 1.0 | 1.2 | 1.4 | 1.4 | 1.4 | 1.2 | 1.0 |
| 2400 | 1.0 | 1.2 | 1.4 | 1.4 | 1.4 | 1.2 | 1.0 |
| 3200 | 1.0 | 1.3 | 1.4 | 1.4 | 1.4 | 1.3 | 1.0 |
| 4000 | 1.0 | 1.4 | 1.4 | 1.4 | 1.4 | 1.4 | 1.0 |
| 4800 | 1.0 | 1.4 | 1.4 | 1.4 | 1.4 | 1.4 | 1.0 |

FIG. 9

PGRMX (%)

| NE (rpm) \ PM (mmHg) | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

FIG. 10

TAU KTPRG (%)

| NE (rpm) \ PM (mmHg) | 300 | 350 | 400 | 450 | 500 | 550 | 600 | 650 | 700 | 750 |
|---|---|---|---|---|---|---|---|---|---|---|
| 500 | -30 | -30 | -30 | -35 | -35 | -35 | -35 | -40 | -40 | -40 |
| 1000 | -30 | -30 | -30 | -35 | -35 | -35 | -35 | -40 | -40 | -40 |
| 1500 | -30 | -30 | -30 | -35 | -35 | -35 | -35 | -40 | -40 | -45 |
| 2000 | -35 | -35 | -35 | -35 | -35 | -40 | -40 | -40 | -45 | -45 |
| 2500 | -35 | -35 | -35 | -35 | -40 | -40 | -45 | -45 | -50 | -50 |
| 3000 | -40 | -40 | -40 | -40 | -40 | -40 | -45 | -50 | -50 | -50 |
| 3500 | -40 | -40 | -40 | -40 | -40 | -45 | -50 | -50 | -50 | -50 |
| 4000 | -40 | -40 | -40 | -40 | -45 | -45 | -50 | -50 | -50 | -50 |

AIR-FUEL RATIO CONTROLLER FOR AN INTERNAL COMBUSTION ENGINE

CROSS-REFERENCE TO RELATED APPLICATIONS

The present application is related to and claims priority from Japanese Patent Application No. Hei 9-131806 filed on May 22, 1997, the contents of which are incorporated herein by reference.

DETAILED DESCRIPTION OF THE INVENTION

1. Technical Field of the Invention

This invention relates to an air-fuel ratio controller for an internal combustion engine that controls discharge of evaporated fuel in a fuel tank to an air-intake side of an engine, and that subsequently combusts and purges the evaporated fuel.

2. Related Art

Japanese Patent Application Laid-open No. Hei 7-83096 discloses an air-fuel ratio controller for an internal combustion engine that detects fuel concentration during purge execution based on a purge air-fuel ratio feedback value (coefficient), and subsequently corrects the quantity of fuel injected to the engine.

When the air-fuel ratio during purge execution is changed by an air-fuel ratio controller for an internal combustion engine, the extent of the effect on the air-fuel ratio due to purging also changes. Therefore, the correction value for the required fuel quantity (fuel-injection quantity) changes, causing fluctuation in the air-fuel ratio. This condition leads to degradation of vehicle drivability and emissions performance.

SUMMARY OF THE INVENTION

Therefore, it is an object of the present invention to provide an air-fuel ratio controller for an internal combustion engine that is capable of obtaining stabilized air-fuel ratio controllability, even when an air-fuel ratio is changed during purge execution.

In particular, the present invention provides an air-fuel ratio controller including a purge controller that controls the opening of a purge solenoid valve, when fuel vapor adsorbed in a canister is expelled to a purge tank, to correct the fuel-injection quantity. An air-fuel ratio changing device changes the air-fuel ratio $\lambda$ in correspondence with a running state of the internal combustion engine. Further, a parameter-correcting device corrects a control parameter relating to the purge controller in correspondence with the air-fuel ratio $\lambda$ due to the air-fuel ratio changing device.

Consequently, even when the air-fuel ratio $\lambda$ is changed by the air-fuel ratio changing device, the opening of the purge solenoid valve is controlled by the ECU so that the purge ratio becomes a predetermined ratio, and the fuel-injection quantity is corrected in correspondence thereto. Thus, stabilized air-fuel ratio controllability can be obtained by correcting the parameters in purge control, even when the air-fuel ratio $\lambda$ is changed during purge execution.

Further, the present invention provides an air-fuel ratio controller for an internal combustion engine including a purge controller to control opening of the purge solenoid valve 45 when discharging fuel vapor adsorbed in a canister to the air-intake side of an internal combustion engine in correspondence with a differing air-fuel ratio. A purge-concentration computing device achieved calculates the extent of effect of purging by the purge-controlling device as a purge concentration, i.e., evaporative-emission concentration, with respect to the predetermined air-fuel ratio $\lambda$. A fuel-quantity correcting device corrects the fuel-injection quantity supplied to the internal combustion engine by the purge correction coefficient as the fuel correction quantity due to purging calculated on a basis of the evaporative-emission concentration calculated by the computing device. As a result, stabilized air-fuel ratio controllability can be obtained by correcting the fuel-injection quantity in consideration of the extent of effect in purge control, even when the air-fuel ratio $\lambda$ is changed during purge execution.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 6A and 6B are timing diagrams indicating a transitional state of the target air-fuel ratio with respect to output of an oxygen sensor;

FIG. 7 is a flow diagram indicating processing steps for a modification of setting a target air-fuel ratio by the CPU in the air-fuel ratio controller according to the present invention;

FIG. 9 is a map for setting the fully open purge ratio in FIG. 8;

FIG. 10 is a map for setting the target TAU correction quantity in FIG. 8;

PREFERRED EMBODIMENT OF THE INVENTION

Figure 1:
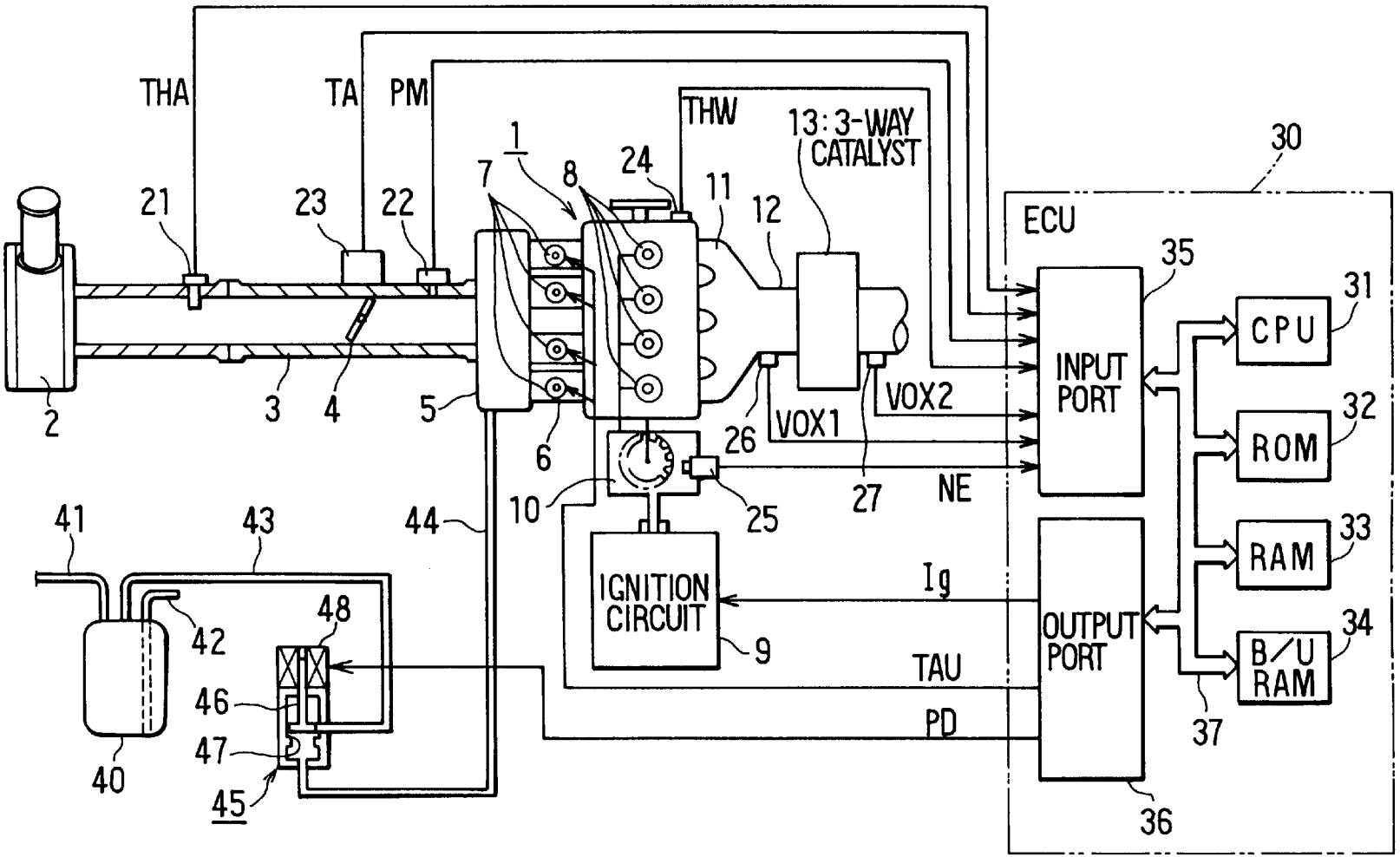
FIG. 1 is an overall structural view of an air-fuel ratio controller for an internal combustion engine according to a preferred embodiment of this invention.

Referring to the drawings, FIG. 1 is a model diagram of a double overhead-cam internal combustion engine, and peripheral components thereof. An air-fuel ratio controller according to a first embodiment of the present invention is implemented with the engine for control purposes to be discussed in detail below.

In FIG. 1, the internal combustion engine 1 is a four-cylinder, four-cycle spark-ignition type. Intake air therefor passes from an upstream side through an air cleaner 2, an intake-air passage 3, a throttle valve 4, a surge tank 5, and an intake manifold 6. The air is mixed with fuel injected from a fuel-injection valve 7 within the intake manifold 6, and is distributively supplied to several cylinders as a mixture of a predetermined air-fuel ratio. A spark plug 8 is provided in each of the several cylinders of the internal combustion engine 1, and high-voltage current supplied from an ignition circuit 9 is supplied to the several spark plugs 8 via a distributor 10. Accordingly, exhaust gas after combustion passes through an exhaust manifold 11 and an exhaust-gas passage 12. Noxious components thereof (carbon monoxide, hydrocarbons, nitrogen oxides, and the like) are reduced by a three-way catalyst 13 disposed in the exhaust-gas passage 12 and carrying a catalyst of platinum, rhodium, or the like and an additive of cerium, lanthanum, or the like. After passing through the catalyst, the exhaust gas is discharged to the atmosphere.

An intake-air temperature sensor 21 and an intake-air pressure sensor 22 are provided in the intake-air passage 3. The intake-air temperature sensor 21 detects intake-air temperature THA downstream of the air cleaner 2, and the intake-air pressure sensor 22 detects intake-air pressure PM downstream of the throttle valve 4. Additionally, a throttle-valve opening sensor 23 to detect throttle opening TA is disposed in the throttle valve 4. This throttle-valve opening sensor 23 outputs an on/off signal to the throttle valve 4 from an idle switch (not illustrated) to detect whether the throttle valve 4 is substantially fully closed, together with an analog signal corresponding with the throttle opening TA.

Additionally, a water-temperature sensor 24 is disposed on the cylinder block of the internal combustion engine 1. This water-temperature sensor 24 detects coolant-water temperature THW within the internal combustion engine 1. A crank-angle sensor 25 detects the engine speed NE of the internal combustion engine 1, and is disposed within the distributor 10. This crank-angle sensor 25 outputs 24 pulse signals per two rotations, (per 720° crank angle) of a crankshaft of the internal combustion engine. Further, an A/F sensor 26 outputs a linear air-fuel ratio signal VOX1 corresponding to an air-fuel ratio $\lambda$ of exhaust gas discharged from internal combustion engine 1, and is disposed upstream of the three-way catalyst 13. An oxygen ($O_2$) sensor 27 outputs a voltage signal VOX2 according to whether the air-fuel ratio $\lambda$ of the exhaust gas is richer or leaner than a theoretical air-fuel ratio $\lambda$ (=1), and is disposed downstream of the three-way catalyst 13.

An electronic control unit (ECU) 30 to control the running state of the internal combustion engine 1 is structured as a microprocessor primarily made up of a central processing unit (CPU) 31, a ROM 32 that stores control programs, a RAM 33 that stores various data, a backup (B/U) RAM 34, and other known components. The ECU 30 is connected via a bus 37 to an input port 35 to input detection signals of the respective sensors, and to an output port 36 to output control signals to several actuators. The intake-air temperature THA, intake-air pressure PM, throttle opening TA, coolant-water temperature THW, engine speed NE, air-fuel ratio signal VOX1, and voltage signal VOX2, and other signals from the several sensors are input to the ECU 30 via the input port 35. The ECU 30 calculates fuel-injection quantity TAU, ignition timing Ig, and control duty PD on a basis of these several values, and outputs respective control signals via the output port to the injector 7, the ignition circuit 9, and a purge solenoid valve 45 which will be described later.

A purge tube 41 extends from an upper portion of a fuel tank (not illustrated) and communicates with the surge tank 5 of the intake-air passage 3. A canister 40 contains activated charcoal for adsorbing evaporated fuel occurring within the fuel tank and is connected to the purge tube 41 as shown. An atmosphere-release hole 42 for inducting outside air is disposed in the canister 40. The purge tube 41 on the surge-tank side of the canister 40 includes discharge passages 43, 44.

The purge solenoid valve 45 is disposed as a variable-flow electromagnetic valve between these discharge passages 43, 44. In the purge solenoid valve 45, a valve body 46 is always urged by a spring (not illustrated) in the closing direction of a seat portion 47. The valve body 46 is made to open the seat portion 47 upon excitation of a coil 48. Consequently, the interval between the discharge passages 43, 44 is closed by de-excitation of the coil 48, and the interval between the discharge passages 43, 44 is opened by excitation of the coil 48. The opening degree of this purge solenoid valve 45 is adjusted by the ECU 30, which will be described later, through duty control based on pulse-width modulation.

Consequently, when a control signal is supplied to the purge solenoid valve 45 from the ECU 30, so that the canister 40 communicates with the surge tank 5 (intake-air passage 3) of the internal combustion engine 1, fresh air is introduced into the canister 40 from the atmosphere through the release hole 42. This fresh air ventilates the canister, and is sent from the canister to the surge tank 5, and from the surge tank to the cylinders of the internal combustion engine 1. This accomplishes a canister purge for recovery of the adsorbency of the canister 40. Accordingly, the purge air quantity Qp (liter/min) of fresh air introduced via the purge solenoid valve 45 at this time is adjusted by varying the duty (%) of the pulse signals supplied to the purge solenoid valve 45 from the ECU 30.

Figure 2:
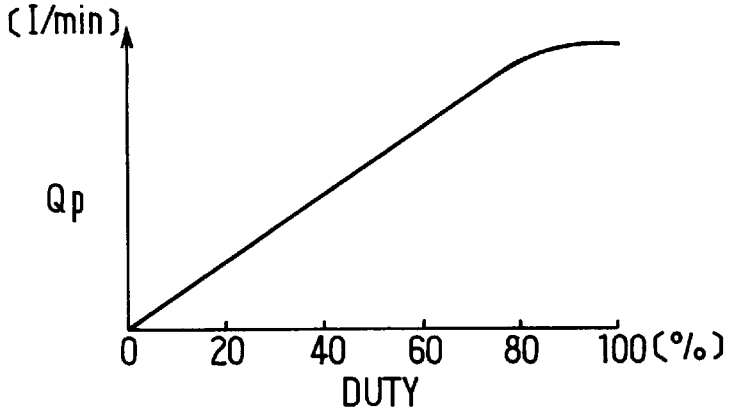
FIG. 2 is a graph indicating purge air quantity versus duty employed in an air-fuel ratio controller according to the present invention.

FIG. 2 graphically indicates the purge air quantity Qp versus duty at this time, and shows the relationship between the duty of the purge solenoid valve 45 and the purge air quantity when a vacuum within the intake-air passage 3 is constant. It is understood from FIG. 2 that, as the duty of the purge solenoid valve 45 increases, the purge air quantity, i.e., the air quantity aspirated into the internal combustion engine via the canister 40, increases substantially linearly.

The ECU 30 receives the intake-air temperature signal THA from the intake-air temperature sensor 21, the intake-air pressure signal PM from the intake-air pressure sensor 22 (this may be replaced by an intake-air quantity signal from an intake-air quantity sensor), a throttle-opening signal TA from the throttle-opening sensor 23, an engine-speed signal NE from the crank-angle sensor 25, and the coolant-water temperature signal THW from the water-temperature sensor 24.

The ECU 30 also receives the voltage signal VOX2 from the oxygen sensor 27, and determines whether the air-fuel mixture is rich or lean. Accordingly, when a reversal from rich to lean or from lean to rich has occurred, in order to increase or decrease the fuel-injection quantity, the ECU 30 causes a large stepwise change (skip) in an FAF value (an air-fuel ratio feedback correction value which will be described later). The ECU also causes this FAF value to gradually increase or decrease when this richness or leanness continues. This air-fuel ratio feedback control is not performed when coolant-water temperature is low, when engine load is high, or when the engine operates at high rpm. Additionally, the ECU 30 determines basic injection time from engine speed and intake-air pressure, performs correction for the basic injection time according to the FAF value, determines final injection time, and causes the injector 7 to perform fuel injection at a specified injection aiming.

The air-fuel ratio controller for an internal combustion engine according to the present invention executes respective programs for establishment of fuel-injection quantity, establishment of target air-fuel ratio, purge-ratio control, detection of evaporative-emission (evaporated-fuel) concentration, purge-ratio gradual-change control, fuel-injection quantity control, and purge solenoid valve control. Operation of these respective control functions will be described hereinafter.

Establishment of Fuel-injection Quantity

Figure 4:
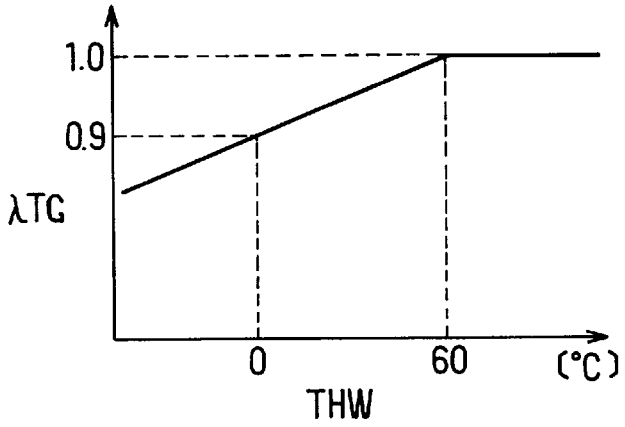
FIG. 4 is a map for setting the target air-fuel ratio in FIG. 3 from coolant-water temperature.

A routine for establishment of fuel-injection quantity will be described with reference to FIGS. 3 and 4. FIG. 4 is a map depicting target air-fuel ratio λ TG versus coolant-water temperature THW (°C.). The routine for establishment of fuel-injection quantity is executed by the CPU 31 within the ECU 30 at every 360° CA in synchronization with revolution of the internal combustion engine 1.

Figure 3:
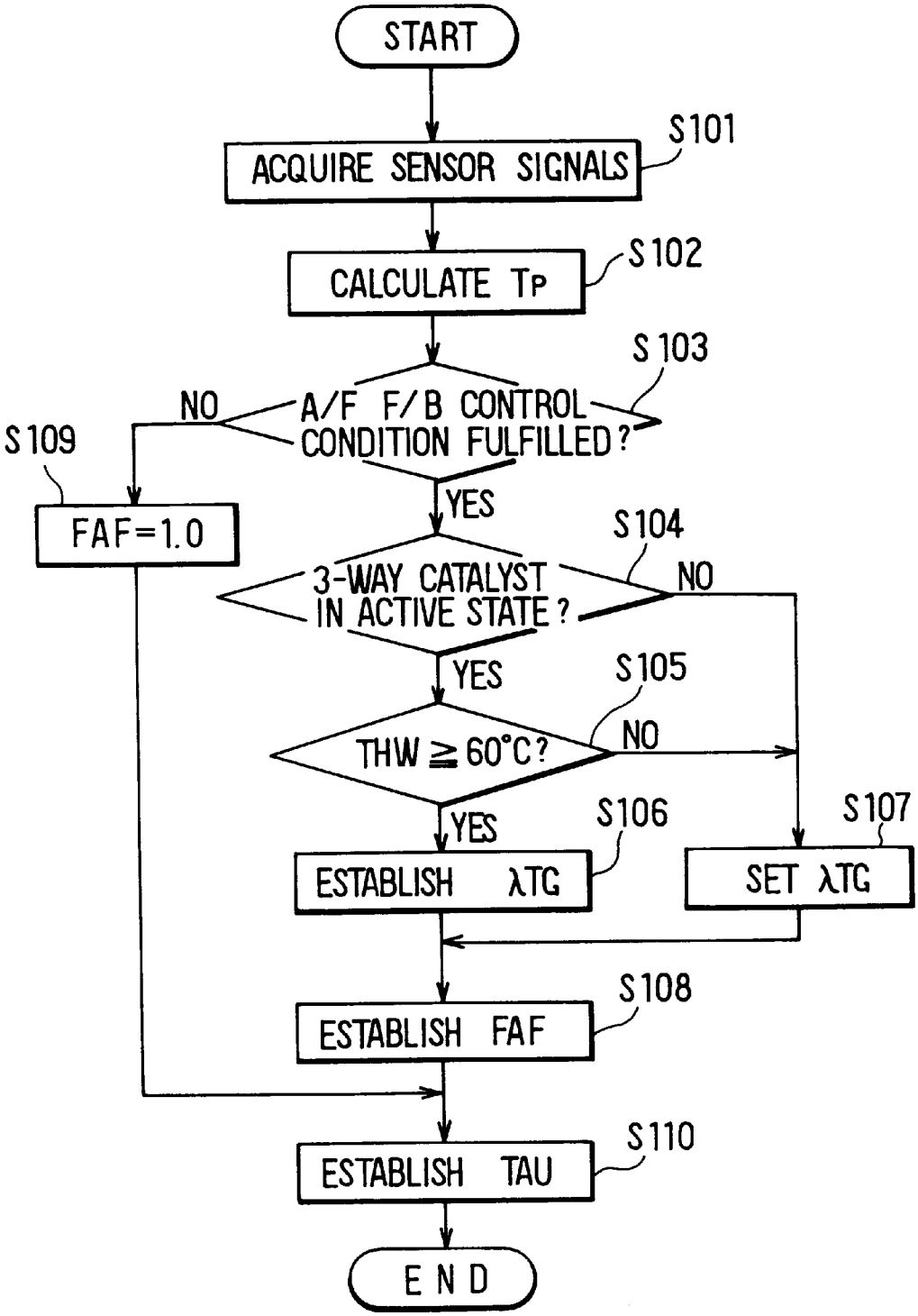
FIG. 3 is a flow diagram indicating processing steps for setting fuel-injection quantity by a CPU in the air-fuel ratio controller according to the present invention.

In FIG. 3, first, at step S101 the intake-air pressure PM, the engine speed NE, and so on are acquired as respective sensor signals. Next, execution advances to step S102, and a basic fuel-injection quantity TP is calculated on a basis of the several sensor signals acquired at step S101. Execution then advances to step S103, and it is determined whether an air-fuel ratio feedback control condition has been fulfilled. Here, the air-fuel ratio feedback control condition is fulfilled when the fuel-increase quantity after starting is 0%, fuel cutoff is not in progress, high-speed or high-load operation is not in progress, and the air-fuel ratio sensor is in an active state. When the air-fuel ratio feedback control condition is fulfilled at step S103, execution then advances to step S104, and it is determined whether the three-way catalyst 13 is in an active state. When the condition of step S104 is fulfilled, execution advances to step S105 and it is determined whether the coolant-water temperature THW is 60° C. or more. When the condition of step S105 is fulfilled, execution advances to step S106, and the target air-fuel ratio λ TG is established as will be described later.

Meanwhile, when the condition of step S104 is not fulfilled and the three-way catalyst 13 is in an inactive state, or when the condition of step S105 is not fulfilled and the coolant-water temperature THW is less than 60° C., execution advances to step S107, and the target air-fuel ratio λ TG is set with respect to the coolant-water temperature THW on a basis of the map shown in FIG. 4. After the target air-fuel ratio λ TG has been set at step S106 or step S107, execution advances to step S108, and the air-fuel ratio feedback correction coefficient FAF is established so that the air-fuel ratio λ becomes the target air-fuel ratio λ TG. That is to say, at step S108 the air-fuel ratio feedback correction coefficient FAF is established according to the target air-fuel ratio λ TG, and the air-fuel ratio signal VOX1 detested by the A/F sensor 26. Meanwhile, when the air-fuel ratio feedback control condition is not fulfilled at step S103, execution advances to step S109, and the air-fuel ratio feedback correction coefficient FAF is set to 1.0. After the air-fuel ratio feedback correction coefficient FAF has been set at step S108 or step S109, execution advances to step S110, fuel-injection quantity TAU is established on a basis of the basic fuel-injection quantity TP, the air-fuel ratio feedback correction coefficient FAF, and another correction coefficient FALL using equation (1) below. Thereafter, the routine ends.

[Equation 1]

$$TAU=TP\times FAF\times FALL \quad (1)$$

A control signal established on a basis of the fuel-injection quantity TAU in this way is output to the injector 7, and valve-opening time, i.e., actual fuel-injection quantity, is controlled. As a result thereof, the air-fuel mixture is adjusted to the target air-fuel ratio λ TG.

Establishment of Target Air-fuel Ratio

A routine for establishment of target air-fuel ratio will be described with reference to FIGS. 5 and 6A–6B. FIGS. 6A–6B show a transitional state of the target air-fuel ratio λ TG with respect to the voltage signal VOX2, which is the output of the oxygen sensor 27. This routine is executed by the CPU 31 within the ECU 30 at every 360° CA in synchronization with revolution of the internal combustion engine 1.

Figure 5:
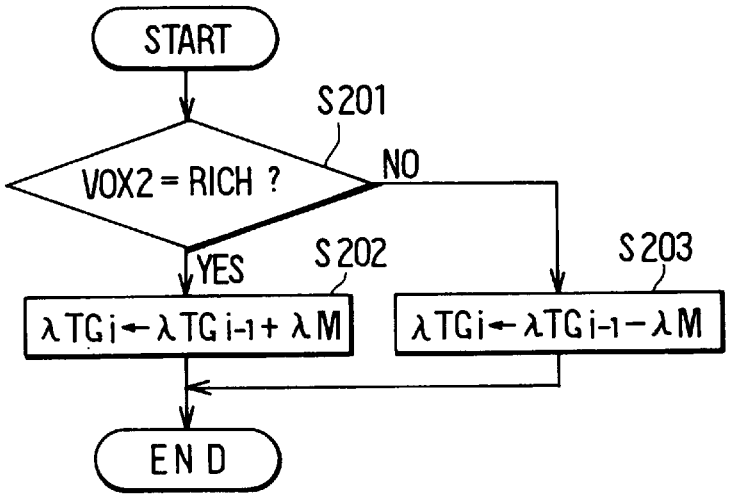
FIG. 5 is a flow diagram indicating processing steps for setting a target air-fuel ratio by the CPU of the controller of the present invention.

In FIG. 5, at step S201 it is determined whether the voltage signal VOX2 from the oxygen sensor 27 is on the rich side (R). When the condition of step S201 is fulfilled and the air-fuel ratio is on the rich side (R), execution advances to step S202, and a predetermined value λ M is added to the previous target air-fuel ratio λ TGi-1; that is, the present target air-fuel ratio λ TGi is established at a value more on the lean side (L) than the previous target air-fuel ratio λ TGi-1. Thereafter, this routine ends. Meanwhile, when the condition of step S201 is not fulfilled and the air-fuel ratio is on the lean side (L), execution advances to step S203, and a predetermined value λ M is subtracted from the previous target air-fuel ratio λ TGi-1; that is, the present target air-fuel ratio λ TGi is established at a value more on the rich side (R) than the previous target air-fuel ratio λ TGi-1. Thereafter, this routine ends.

Modification for Establishment of Target Air-fuel Ratio

A modification of a routine for establishment of target air-fuel ratio will be described with reference to FIG. 7. This modification is executed by the CPU 31 within the ECU 30 at every 360° CA, in synchronization with revolution of the internal combustion engine 1.

In FIG. 7, at step S301 it is determined whether the engine is running at idle. When the condition of step S301 is not fulfilled, execution advances to step S302, and it is determined whether steady running is in progress. A determination condition for this may be, for example, a case wherein an engine-speed change quantity ΔNE is 200 rpm or less, and an intake-air pressure change quantity ΔPM is 100 mmHg or less. When the condition of step S302 is fulfilled and steady running is in progress, execution advances to step S303, and the target air-fuel ratio λ TG is set on a basis of a map taking the engine speed NE (rpm) and the intake-air pressure PM (mmHg) as parameters. Thereafter, this routine ends. Meanwhile, when the engine is running at idle at step S301, or when steady running is not in progress at step S302, execution advances to step S304, and the target air-fuel ratio λ TG is caused to be 1.0. Thereafter, this routine ends.

Purge-ratio Control

A routine for establishment of fuel-injection quantity will be described with reference to FIGS. 9 and 10, and with reference to FIG. 8. FIG. 9 is a map indicating a fully open purge ratio PGRMX (%), which is determined by the engine speed NE (rpm) and the intake-air pressure PM (mmHg—in this embodiment, vacuum is taken to be intake-air pressure, but intake-air quantity or throttle opening may be employed instead). This map is stored in the ROM 32 and indicates the ratio of an air quantity flowing through the discharge passages 43, 44 when duty of the purge solenoid valve 45 is 100%, to a total intake-air quantity flowing through the intake-air passage 3 and into the internal combustion engine 1. FIG. 10 is a map indicating a target TAU correction quantity KTPRG (%), which is determined by the engine speed NE (rpm) and the intake-air pressure PM (mmHg—in this embodiment, vacuum is taken to be intake-air pressure, but intake-air quantity or throttle opening may be employed instead). This purge-ratio control routine is executed by the CPU 31 within the ECU 30 approximately every 4 ms.

Figure 8:
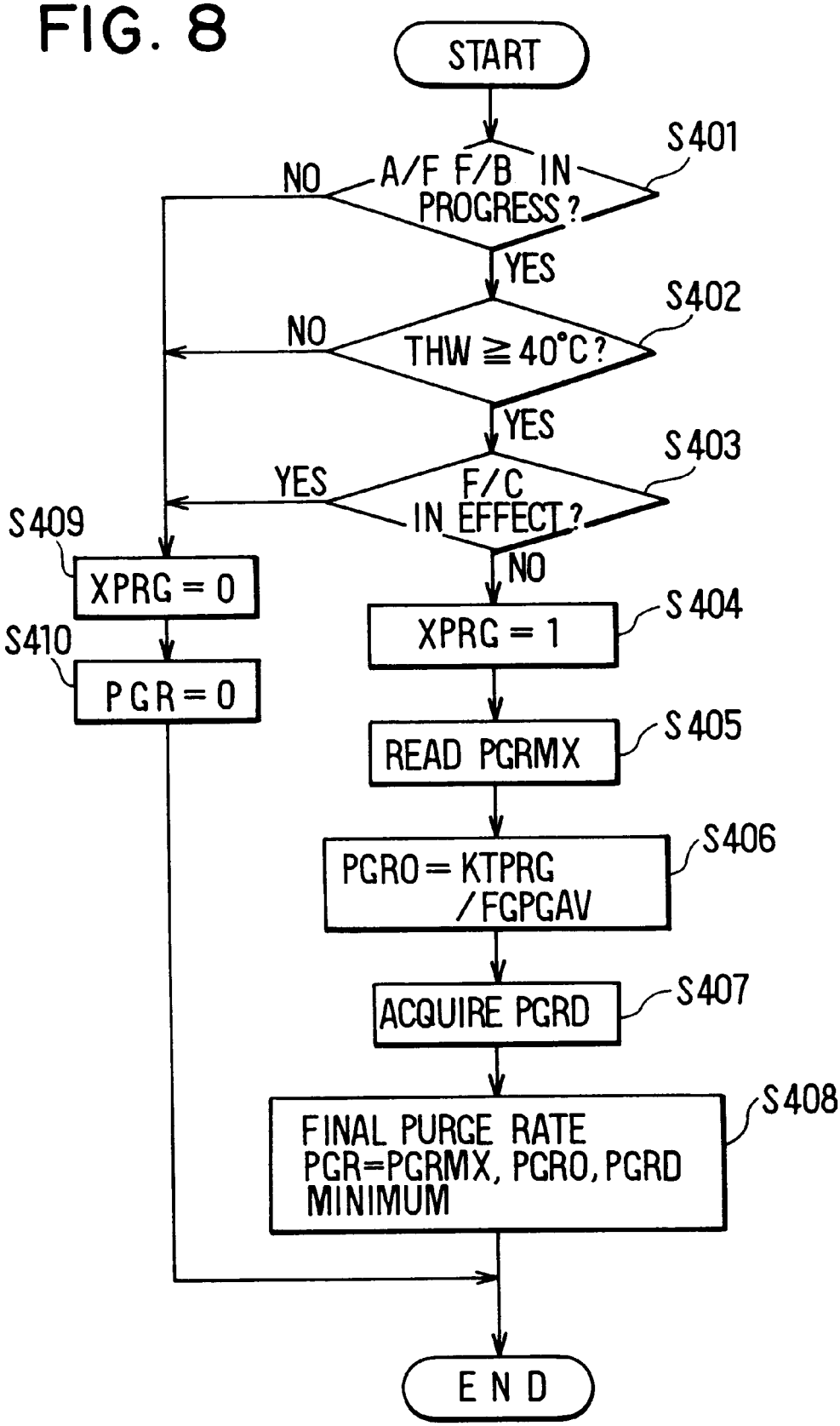
FIG. 8 is a flow diagram indicating processing steps for purge-ratio control by the CPU in the air-fuel ratio controller according to the present invention.

In FIG. 8, at step S401 it is determined whether air-fuel ratio feedback is in progress. At step S402, it is determined whether coolant-water temperature THW is 40° C. or more. At step S403, it is determined whether fuel cutoff is in effect. The determination condition of step S401 is for canceling a state of control during conditions such as engine start-up. The determination condition of step S401 is for canceling a state of fuel-quantity increment correction of other than purging by water-temperature correction. The determination condition of step S403 is for not executing purging during fuel cutoff. When the conditions of step S401 and step S402 are fulfilled and the condition of step S403 is not fulfilled, execution advances to step S404, and a purge-execution flag XPRG is set to 1.

Next, execution advances to step S405, and the fully open purge ratio PGRMX is read from the map shown in FIG. 9 on a basis of the intake-air pressure PM and the engine speed NE. Next, execution advances to step S406, and a target purge ratio PGRO is calculated from the target TAU correction quantity KTPRG and the evaporative-emission concentration average FGPGAV. Here, the target TAU correction quantity KTPRG indicates whether quantity-decrement correction of the maximum applicable fuel-injection quantity is possible in a case of replenishing fuel gas by executing purge. This target TAU correction quantity KTPRG is initially established on a basis of an allowance relative to the minimum injection pulse of the injector 7. This target TAU correction quantity KTPRG is converted into a two-dimensional map as shown in FIG. 10, with the intake-air pressure PM and the engine speed NE as parameters indicating the running state of the internal combustion engine 1, and is programmed into the ROM 32. This map is established so that the targeting TAU correction quantity KTPRG tends to become smaller during a running state wherein the basic fuel-injection quantity TP is low.

The evaporative-emission concentration average FGPGAV corresponds to the fuel-gas adsorption quantity in the canister 40. The value is estimated by processing which will be described later, and is stored in the RAM 33 while being periodically updated. The target purge ratio PGRO corresponds to the amount of fuel gas to be replenished by purging, assuming full reduction of the fuel-injection quantity up to the target TAU correction quantity KTPRG. When the engine running state is the same, the target purge ratio PGRO becomes smaller as the evaporative-emission concentration average FGPGAV becomes larger, and vice versa.

After the target purge ratio PGRO has been calculated in this way, execution advances to step S407, and a purge-ratio gradual-change value PGRD is acquired. This purge-ratio gradual-change value PGRD is a control value established to avoid a situation wherein a sudden large change in the purge ratio makes it impossible for correction to keep up with such an increase and maintain an optimal air-fuel ratio. A method of establishing the purge-ratio gradual-change value PGRD will be described in detail later as it relates to purge-ratio gradual-change control.

Next, execution advances to step S408, and the minimum value among the fully open purge ratio PGRMX of step S405, the target purge ratio PGRO of step S406, and the purge-ratio gradual-change value PGRD of step S408 is determined as the final purge ratio PGR for executing purge control. Afterwards, this routine ends. Meanwhile, when the condition of step S401 or step S402 is not fulfilled, or when the condition of step S403 is fulfilled, execution advances to step S409, and the purge-execution flag is set to 0. Next, execution advances to step S410, and the final purge ratio PGR is set to 0. Thereafter, this routine ends. Here, setting the final purge ratio PGR to 0 signifies that purge control is not performed.

Detection of Evaporative-emission Concentration

A routine for detection of evaporative-emission concentration will be described based on FIG. 11. This routine for detection of evaporative-emission concentration is executed by the CPU 31 within the ECU 30 approximately every 4 ms.

Figure 11:
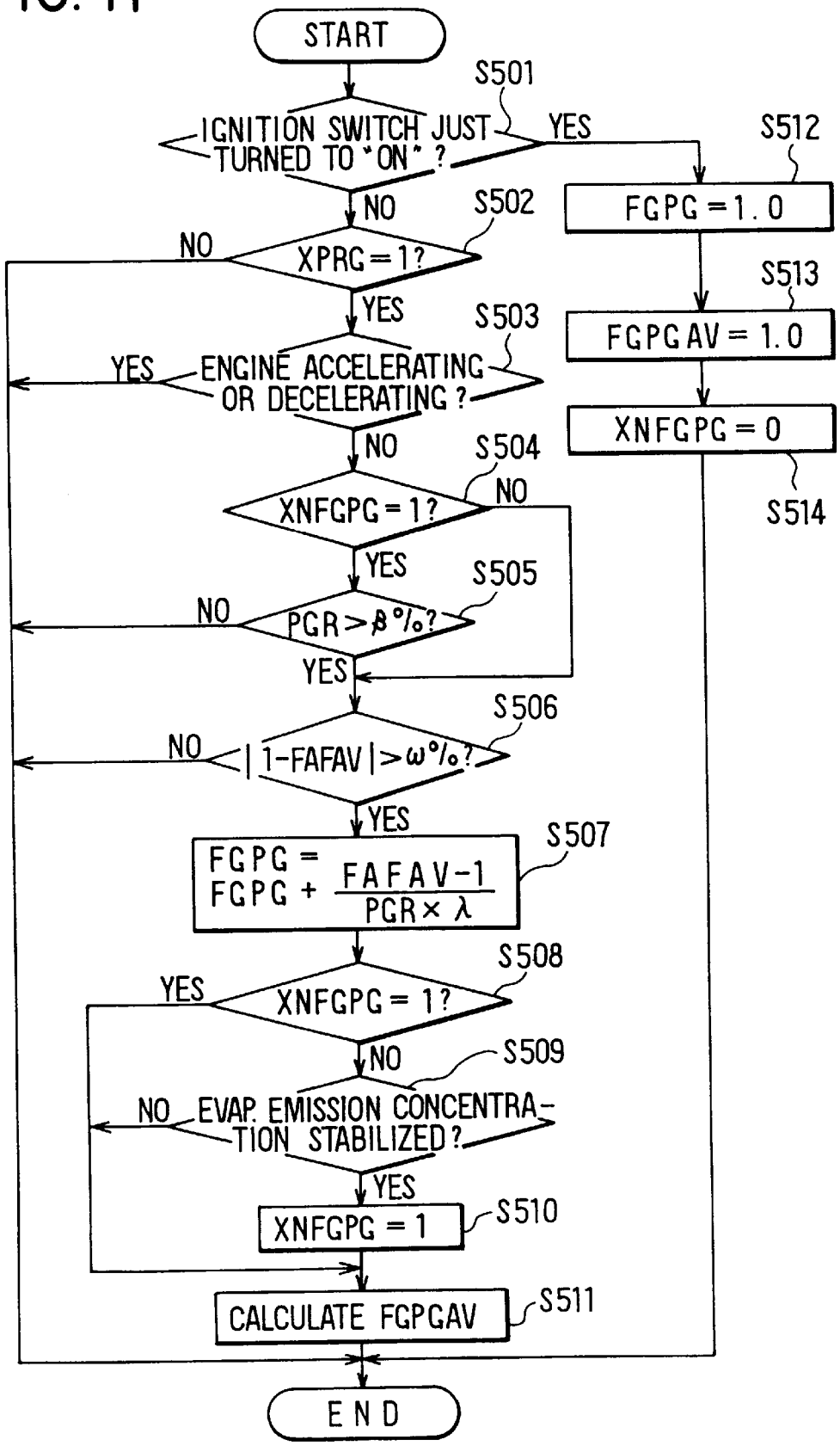
FIG. 11 is a flow diagram indicating processing steps for detecting evaporative-emission concentration by the CPU in the controller of the present invention.

In FIG. 11, first, at step S501, it is determined whether an ignition switch has just been switched on. This step avoids error caused by use of the previously detected value because, during stoppage of the internal combustion engine, evaporated fuel is further adsorbed by the canister 40. When the condition of step S501 is not fulfilled and the ignition switch has not just been switched on, execution advances to step S502 and it is determined whether the purge-execution flag XPRG is 1 and purge control has been initiated. When the condition of step S502 is not fulfilled, the purge-execution flag XPRG is 0, and purge control has not yet been initiated. As a result, the evaporative-emission concentration cannot be detected. Therefore, the routine ends. Meanwhile, when the condition of step S502 is fulfilled, execution advances to step S503, and it is determined whether acceleration or deceleration is in progress. Here, determination of whether acceleration or deceleration is in progress may be performed by a generally known method, such as by detecting change in the opening of an idle switch or throttle valve, detecting change in intake-air pressure, or a change in vehicle speed. When the condition of step S502 is fulfilled and acceleration or deceleration is in progress, the running state is in an excessive state, and a correct evaporative-emission concentration cannot be detected. Therefore, this routine ends.

Meanwhile, when the condition of step S503 is not fulfilled, execution advances to step S504, and it is determined whether the initial-concentration detection-end flag XNFGPG is 1. Initially, detection of concentration has not ended, and so the condition of step S503 is not fulfilled. Therefore, execution advances to step S506, and skips step S505. At step S506 it is determined whether an absolute value of deviation between an averaged value FAFAV and a reference value 1 exceeds a predetermined value ω%). The averaged value FAFAV is obtained by averaging, at every iteration of a predetermined time interval, the air-fuel ratio feedback correction coefficient FAF established at step S108 of FIG. 3. The evaporative-emission concentration cannot accurately be detected unless an obvious deviation occurs in the air-fuel ratio as a result of purge control. The predetermined value ω% signifies a range of variation.

When the condition of step S506 is not fulfilled, this routine ends. Meanwhile, when the condition of step S506 is fulfilled, execution advances to step S507, the deviation (FAFAV−1) is divided by a value equal to the final purge ratio PGR multiplied by the air-fuel ratio λ, and the quotient obtained is added to the previous evaporative-emission concentration FGPG to yield the present evaporative-emission concentration FGPG. Consequently, the value of the evaporative-emission concentration FGPG in this embodiment is set to 1 when the evaporative-emission concentration in the discharge passages 43, 44 is 0 (100% air), and is set to a value correspondingly smaller than 1 as the evaporative-emission concentration in the discharge passages 43, 44 becomes higher. Here, at step S507, evaporative-emission concentration may be calculated by replacing the averaged value FAFAV with the reference value 1, so that the evaporative-emission concentration FGPG is set to a value correspondingly larger than 1 as the evaporative-emission concentration becomes higher.

When calculating the evaporative-emission concentration FGPG at step S507, the final purge ratio PGR is multiplied by the air-fuel ratio λ even when the air-fuel ratio λ is changed by a predetermined ratio during purging. Thus, the extent of the effect on the evaporative-emission concentration FGPG due to changing of the air-fuel ratio λ during purge control can be eliminated.

Next, execution advances to step S508, and it is determined whether the initial-concentration detection-end flag XNFGPG is 1. Initially, detection of concentration has not ended, and so the condition of step S508 is not fulfilled, and execution advances to step S509. At step 509, it is determined whether the evaporative-emission concentration has stabilized by determining whether a state of change between the previously detected evaporative-emission concentration FGPG and the presently detected evaporative-emission concentration FGPG of a predetermined value 0% or less has continued for three or more iterations. When the condition of step S509 is fulfilled and the evaporative-emission concentration has stabilized, execution advances to step S510, and the initial-concentration detection-end flag XNFGPG is set to 1. After the processing of step S510, or when the condition of step S508 is fulfilled and the initial-concentration detection-end flag XNFGPG is 1, and steps S509 and step S510 are skipped, or when the condition of step S509 is not fulfilled, and the evaporative-emission concentration is not stabilized and step S510 is skipped, execution proceeds to step S511. At step S511, the evaporative-emission concentration average FGPGAV is calculated by averaging the present evaporative-emission concentration FGPG, and so predetermined averaging computation (for example, 1/64 averaging) is executed. Thereafter, this routine ends.

After initial concentration detection ends, the condition of step S504 is always fulfilled, and so execution advances to step S505. At step S505, it is determined whether the purge ratio PGR exceeds a predetermined value β (%). When the condition of step S505 is not fulfilled and the purge ratio PGR is the predetermined value a % or less, this routine ends. Meanwhile, when the condition of step S505 is fulfilled, the processing of step S506 and after is executed. When the purge ratio PGR is small, i.e., when the purge solenoid valve 45 is on the low flow-rate side, the opening cannot be controlled with much accuracy, making it impossible to accurately detect the evaporative-emission concentration. Accordingly, apart from the initial iteration, detection of the evaporative-emission concentration is executed solely when conditions permitting accurate detection are obtained for the other iterations, so as to yield values which are as free from error as possible.

Meanwhile, when the ignition switch has just been switched on at step S501, the evaporative-emission concentration FGPG is set to 1.0 at step S512, the evaporative-emission concentration average FGPGAV is set to 1.0 at step S513, the initial-concentration detection-end flag XNFGPG is initialized to 0 at step S514, and the routine ends. This setting of the evaporative-emission concentration FGPG and the evaporative-emission concentration average FGPGAV to 1.0 signifies that the evaporative-emission concentration is 0 (no fuel gas has been adsorbed). Initially, setting of the initial-concentration detection-end flag XNFGPG to 0 means that evaporative-emission concentration has not yet been detected.

Purge-ratio Gradual-change Control

A routine for purge-ratio gradual-change control will be described on the basis of FIG. 12. This routine for purge-ratio gradual-change control is executed by the CPU 31 within the ECU 30 approximately every 4 ms.

Figure 12:
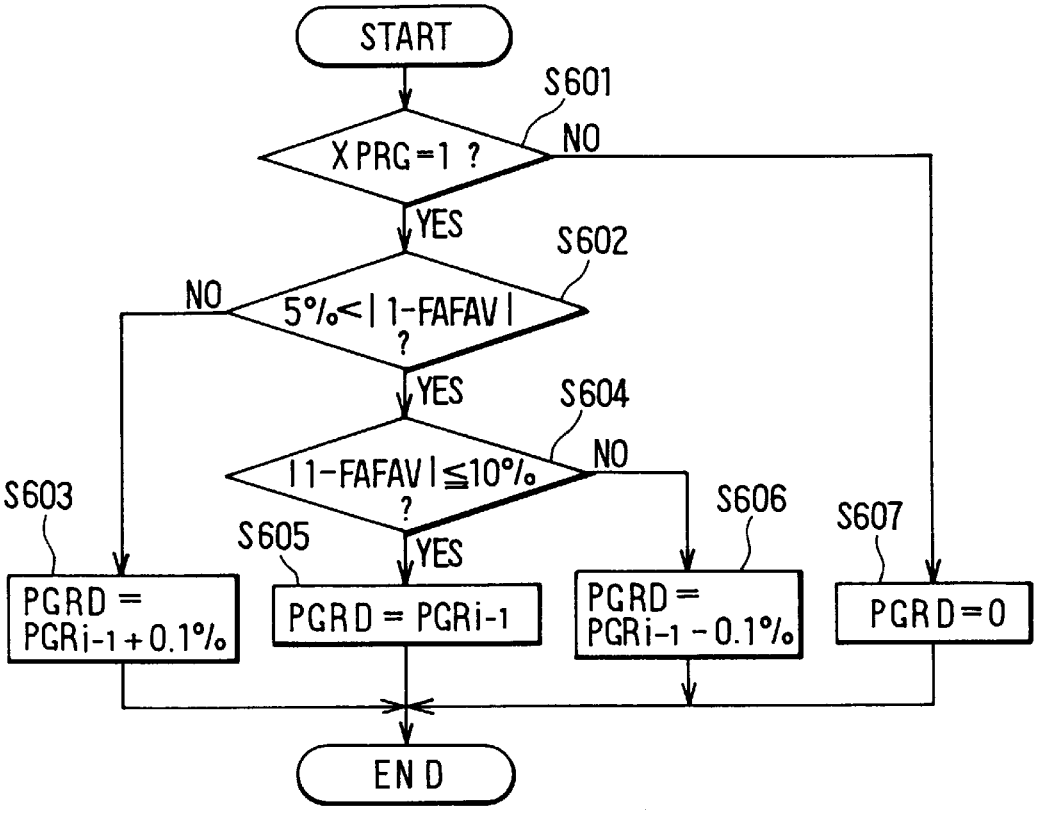
FIG. 12 is a flow diagram indicating processing steps for purge-ratio slow-change value control by the CPU in the controller of the present invention.

In FIG. 12, firstly, at step S601 it is determined whether the purge-execution flag XPRG is 1. When the condition of step S601 is fulfilled, execution advances to step S602, and it is determined whether deviation |1−FAFAV|, as an amount of shift of the air-fuel ratio feedback correction coefficient FAF, exceeds 5%. When the condition of step S602 is not fulfilled, execution advances to step S603, and a value equal to the previous final purge ratio PGRi-1 plus 0.1% is established as the purge-ratio gradual-change value PGRD. Thereafter, the routine ends. Meanwhile, when the condition of step S602 is fulfilled, execution advances to step S604, and it is determined whether the deviation |1−FAFAV| is 10% or less. When the condition of step S604 is fulfilled, execution advances to step S605, and a value taking the previous final purge ratio PGRi-1 to be the final purge ratio PGRi-1 is established as the purge-ratio gradual-change value PGRD. Thereafter, the routine ends.

Meanwhile, when the condition of step S604 is not fulfilled, execution advances to step S606, and a value equal to the previous final purge ratio PGRi-1 minus 0.1% is established as the purge-ratio gradual-change value PGRD. Thereafter, this routine ends. When the condition of step S601 is not fulfilled and the purge-execution flag XPRG is 0, execution advances to step S607, and the purge-ratio gradual-change value PGRD is set to 0, with the routine ending thereafter.

In this way, in a state where the air-fuel ratio feedback correction coefficient FAF deviates from the theoretical or stoichiometric air-fuel ratio (FAF=1) by 5% or less, fuel-injection quantity TAU correction is considered to be able to keep up with further change in the purge ratio, and the purge ratio is further modified. When the air-fuel ratio feedback correction coefficient FAF remains within a deviation of 5% to 10% of the theoretical or stoichiometric air-fuel ratio (FAF=1), the change in purge ratio and the fuel-injection quantity TAU correction are considered to be comparatively balanced, and the purge ratio is maintained unchanged. When the air-fuel ratio feedback correction coefficient FAF deviates by 10% or more from the theoretical or stoichiometric air-fuel ratio (FAF=1), the fuel-injection quantity TAU correction cannot keep up as a result of excessive change in the purge ratio, and action is taken to return the purge ratio toward its original state, as this deviation may increase if left unchecked.

Fuel-injection Quantity Control

Figure 13:
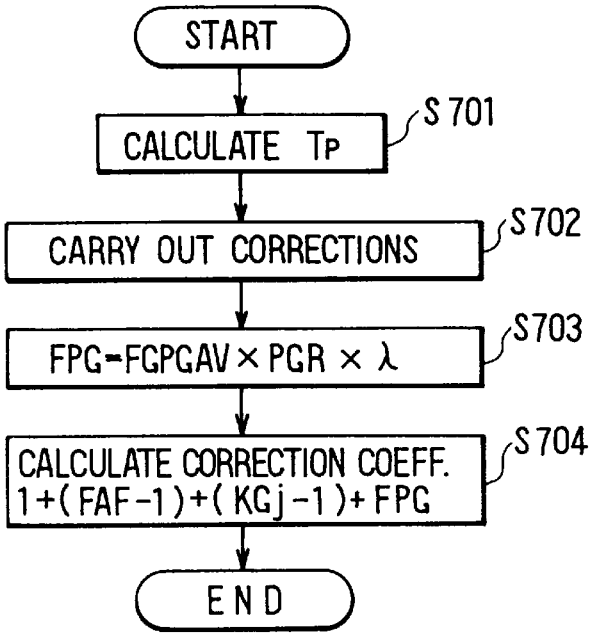
FIG. 13 is a flow diagram indicating processing steps for fuel-injection quantity value control by the CPU in the controller of the present invention.

A routine for fuel-injection quantity control will be described on the basis of FIG. 13. This routine for fuel-injection quantity control is executed by the CPU 31 within the ECU 30 approximately every 4 ms.

In FIG. 12, firstly, at step S701 the basic fuel-injection quantity TP is calculated from the engine speed NE and load (for example, intake-air pressure PM) on a basis of the map stored in the ROM 32. Next, execution advances to step S702, and the various basic corrections (coolant-water temperature correction, post-starting correction, intake-air temperature correction) are executed. Next, execution advances to step S703, and the evaporative-emission concentration average FGPGAV is multiplied by the final purge ratio PGR and the air-fuel ratio λ to calculate a purge correction coefficient FPG.

This purge correction coefficient FPG signifies a fuel quantity replenished by executing a purge under a condition determined by purge-control processing. The purge correction coefficient FPG also indicates a fuel quantity capable of decrement correction from the basic fuel-injection quantity TP. When calculating the purge correction coefficient FPG in this way, the final purge ratio PGR is a value obtained by multiplying the evaporative-emission concentration average FGPGAV by the final purge ratio PGR. PGR is further multiplied by the air-fuel ratio A, even when the air-fuel ratio λ is changed while executing purging at a predetermined ratio, and is set with consideration to the fuel correction quantity due to change in the air-fuel ratio λ during purge control.

Next, execution advances to step S704, and the correction coefficient is calculated using the equation {1+(FAF−1)+(KGj−1)+FPG} from the air-fuel ratio feedback correction coefficient FAF, the purge correction coefficient FPG, and an air-fuel ratio experiential value KGj. This correction coefficient is then multiplied by the basic fuel-injection quantity TP and reflected in the fuel-injection quantity TAU. Thereafter, this routine ends. The air-fuel ratio experiential value KGj is set for each of the respective running regions of the internal combustion engine.

Purge Solenoid Valve Control

A routine for purge solenoid valve control will be described with reference to FIG. 14. This routine for purge solenoid valve control is executed by the CPU 31 within the ECU 30 by time interrupts approximately every 100 ms.

Figure 14:
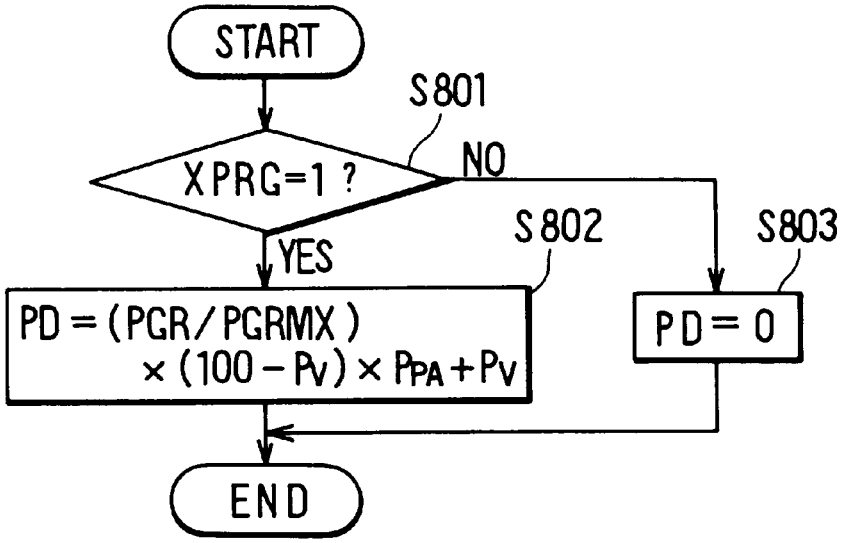
FIG. 14 is a flow diagram indicating processing steps for purge solenoid valve control by the CPU in the controller of the present invention.

In FIG. 14, firstly, at step S801 it is determined whether the purge-execution flag XPRG is 1. When the condition of step S801 is fulfilled, execution advances to step S802, and the control duty PD of the purge solenoid valve 45 is calculated using the equation (2) below. Thereafter, the routine ends.

[Equation 2]

$$PD=(PGR/PGRMX)\times(100-PV)\times PPA+PV \quad (2)$$

Equation (2) takes the drive cycle of the purge solenoid valve 45 to be 100 ms. PGR is the final purge ratio calculated in FIG. 8, PGRMX is the fully open purge ratio in the respective running states of the purge solenoid valve 45 (refer to FIG. 9), PV is a voltage correction value for fluctuation in battery voltage, and PPA is an atmospheric-pressure correction value for fluctuation in atmospheric pressure.

Meanwhile, when the condition of step S801 is not fulfilled and purging is not executed, execution advances to step S803, and the duty PD of the purge solenoid valve 45 is set to 0. Thereafter, the routine ends.

In this way, an air-fuel ratio controller is made up of a purge controller achieved by the ECU 30 to control the opening of the purge solenoid valve 45, when fuel vapor adsorbed in a canister 40 is expelled to the surge tank 5 side of the intake-air side of the internal combustion engine 1, and to correct the fuel-injection quantity. The air-fuel ratio controller is also made up of an air-fuel ratio changing device achieved by the ECU 30 to freely change the air-fuel ratio λ in correspondence with a running state of the internal combustion engine 1, and a parameter-correcting device achieved by the ECU 30 to correct a control parameter relating to the purge controller in correspondence with the air-fuel ratio λ due to the air-fuel ratio changing device.

Consequently, even when the air-fuel ratio λ is changed by the air-fuel ratio changing device, the opening of the purge solenoid valve 45 is controlled by the ECU 30 so that the purge ratio becomes a predetermined ratio, and the fuel-injection quantity TAU from the injector 7 is corrected in correspondence thereto. Because of this, stabilized air-fuel ratio controllability can be obtained by correcting the parameters in purge control, even when the air-fuel ratio λ is changed during purge execution taking a predetermined ratio as the purge ratio.

With an air-fuel ratio controller for an internal combustion engine according to this embodiment, the parameter-correcting device achieved by the ECU 30 employs a fuel-correction quantity due to purging as the control parameter. That is to say, at step S703 of the routine for fuel-injection quantity control, the purge correction coefficient FPG is calculated to set the fuel-injection quantity due to purging as a parameter, in correspondence with the air-fuel ratio λ changed by the ECU 30 achieving the air-fuel ratio changing device. Because of this, stabilized air-fuel ratio controllability can be obtained by compensating for the amount of deviation of the air-fuel ratio feedback correction coefficient FAF with fuel correction, even when the air-fuel ratio λ is changed during purge execution taking a predetermined ratio as the purge ratio.

Further, an air-fuel ratio controller for an internal combustion engine according to this embodiment is made up of: a purge controller achieved by the ECU 30 to control opening of the purge solenoid valve 45 when discharging fuel vapor adsorbed on the canister 40 to the air-intake side of the internal combustion engine 1 in correspondence with a differing air-fuel ratio; a purge-concentration computing device achieved by the ECU 30 to calculate the extent of effect of purging by the purge-controlling device as a purge concentration, i.e., evaporative-emission concentration, with respect to the predetermined air-fuel ratio λ; and a fuel-quantity correcting device achieved by the ECU 30 to ultimately correct the fuel-injection quantity TAU supplied to the internal combustion engine 1 by the purge correction coefficient FPG as the fuel correction quantity due to purging calculated on a basis of the evaporative-emission concentration FGPG calculated by the computing device.

That is to say, the effect of purging with respect to the predetermined air-fuel ratio λ is calculated by the ECU 30, and ultimately the fuel-injection quantity TAU supplied to the internal combustion engine 1 is corrected by the ECU 30. Because of this, stabilized air-fuel ratio controllability can be obtained by correcting the fuel-injection quantity TAU in consideration of the extent of effect in purge control, even when the air-fuel ratio λ is changed during purge execution taking a predetermined ratio as the purge ratio.

Modification of Purge Solenoid Valve Control

A modification of a routine for purge solenoid valve control will be described with reference to FIG. 15. This modification is executed by the CPU 31 within the ECU 30 by time interrupts approximately every 100 ms.

With this modification, change in the air-fuel ratio λ is given consideration when calculating the duty PD of the purge solenoid valve 45. In correspondence with this modification of a routine for purge solenoid valve control, there is no need to give consideration, either to correction by the air-fuel ratio λ in calculation of the evaporative-emission concentration average FGPG at step S507 of the routine for detection of evaporative-emission concentration shown in FIG. 11, or to correction by the air-fuel ratio λ in calculation of the purge correction coefficient FPG at step S703 of the routine for routine for fuel-injection quantity control shown in FIG. 13. Therefore, there are solely computational equations wherein the multiplied λ values are respectively eliminated. Because processing in other steps is similar, detailed description thereof will be omitted.

Figure 15:
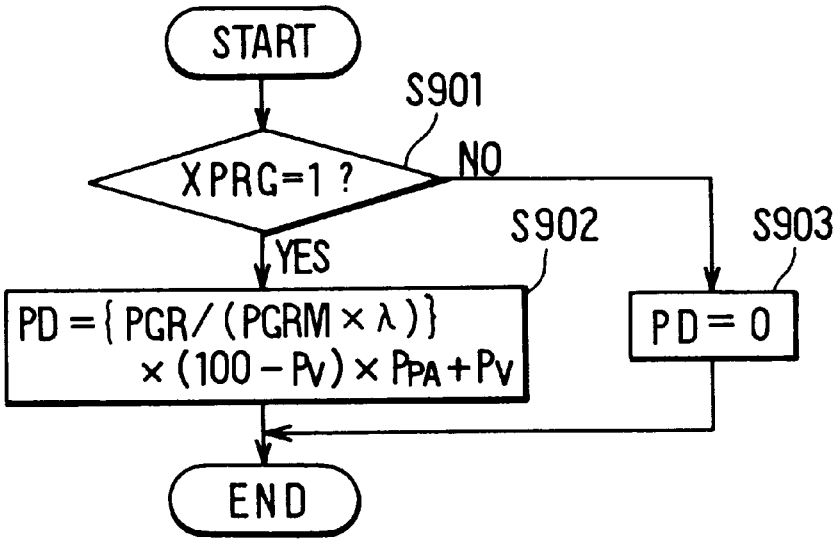
FIG. 15 is a flow diagram indicating processing steps for a modification of purge solenoid valve control by the CPU in the controller of the present invention.

In FIG. 15, firstly, at step S901 it is determined whether the purge-execution flag XPRG is 1. When the condition of step S901 is fulfilled, execution advances to step S902, and the control duty PD of the purge solenoid valve 45 is calculated using the equation (3) below. Thereafter, this routine ends.

[Equation 3]

$$PD=\{PGR/(PGRMX\times\langle LAMBDA\rangle)\times(100-PV)\times PPA+PV \quad (3)$$

Equation 3 takes the drive cycle of the purge solenoid valve 45 to be 100 ms. PGR is the final purge ratio calculated in FIG. 8, PGRMX is the fully open purge ratio in the respective running states of the purge solenoid valve 45 (refer to FIG. 9), PV is a voltage correction value for fluctuation in battery voltage, and PPA is an atmospheric-pressure correction value for fluctuation in atmospheric pressure.

When calculating the duty PD of the purge solenoid valve 45, the fully open purge ratio PGRMX is multiplied by the air-fuel ratio λ. The fuel correction due to the air-fuel ratio λ during purge control is compensated by the opening correction of the purge solenoid valve 45, even when the air-fuel ratio λ is changed during purge execution taking a predetermined ratio as the purge ratio.

Meanwhile, when the condition of step S901 is not fulfilled and purging is not executed, execution advances to step S903, and the duty PD of the purge solenoid valve 45 is set to 0. Thereafter, this routine ends.

In this way, in an air-fuel ratio controller for an internal combustion engine according to this embodiment, the parameter-correcting device achieved by the ECU 30 takes the control duty PD for the opening of the purge solenoid valve 45 as the control parameter. That is to say, the control duty PD of the purge solenoid valve 45 is calculated as the control parameter in correspondence with the air-fuel ratio λ changed by the ECU 30 at step S902 of the routine for purge solenoid valve control, as shown in FIG. 15. Because of this, stabilized air-fuel ratio controllability can be obtained by compensating for the amount of deviation of the air-fuel ratio feedback correction coefficient FAF through purge correction with the control duty PD of the purge solenoid valve 45, even when the air-fuel ratio λ is changed during purge execution taking a predetermined ratio as the purge ratio.

What is claimed is:

1. An air-fuel ratio controller for an internal combustion engine, said controller comprising:

purge control means for controlling a degree of opening of a purge valve during discharge of fuel vapor that has been adsorbed in a canister to an air-intake side of an internal combustion engine, to correct a fuel-injection quantity via a purge correction coefficient;

changing means for changing a target air-fuel ratio in correspondence with a running state of said internal combustion engine; and correcting means for correcting a control parameter relating to said purge control means based on a changed air-fuel ratio.

2. An air-fuel ratio controller for an internal combustion engine according to claim 1, wherein said correcting means utilizes a fuel-correction quantity due to purging as said control parameter.

3. An air-fuel ratio controller for an internal combustion engine according to claim 1, wherein said correcting means utilizes an opening degree of said purge valve as said control parameter.

4. An air-fuel ratio controller for an internal combustion engine according to claim 1, wherein said changing means increases a target air-fuel ratio value if said changing means determines that a presently sensed air-fuel ratio value is lean.

5. An air-fuel ratio controller for an internal combustion engine according to claim 1, wherein said changing means decreases a target air-fuel ratio value if said changing means determines that a presently sensed air-fuel ratio value is rich.

6. An air-fuel ratio controller for an internal combustion engine according to claim 1, wherein said changing means adjusts a target air-fuel ratio value based on sensed engine speed and intake-air pressure parameters.

7. An air-fuel ratio controller for an internal combustion engine according to claim 6, wherein said changing means adjusts a target air-fuel ratio value to a default value of 1.0 when said internal combustion engine is running at idle.

8. An air-fuel ratio controller for an internal combustion engine according to claim 1, wherein said purge control determines a fully-open purge ratio based on sensed engine speed and intake-air pressure parameters.

9. An air-fuel ratio controller for an internal combustion engine according to claim 8, wherein said purge control means determines a target purge ratio from a predetermined target fuel injection correction quantity and an evaporative emission concentration average of the canister.

10. An air-fuel ratio controller for an internal combustion engine according to claim 9, wherein said purge control means acquires a purge-ratio gradual-change value to maintain an optimal air-fuel ratio during large changes in a purge ratio.

11. An air-fuel ratio controller for an internal combustion engine according to claim 10, wherein said purge control means determines a final purge ratio for purge control execution from a minimum value of one of the fully-open purge ratio, the target purge ratio, and the purge-ratio gradual-change value.

12. An air-fuel ratio controller for an internal combustion engine according to claim 1, wherein said purge control means determines an evaporative-emission concentration in the canister based on predetermined engine operating parameters.

13. An air-fuel ratio controller for an internal combustion engine according to claim 1, wherein said purge control means maintains a purge ratio rate of change within predetermined acceptable rate of change parameters.

14. An air-fuel ratio controller for an internal combustion engine according to claim 8, wherein said correcting means determines a target purge ratio from a predetermined target fuel injection correction quantity and an evaporative emission concentration average of the canister.

15. An air-fuel ratio controller for an internal combustion engine according to claim 1, wherein said purge control means determines a basic fuel injection quantity, and then adjusts the basic fuel injection quantity by a correction coefficient.

16. An air-fuel ratio controller for an internal combustion engine according to claim 1, wherein said purge control means controls the degree of opening of the purge valve so that a purge ratio becomes a predetermined ratio, and the fuel-injection quantity is corrected in correspondence thereto.

17. An air-fuel ratio controller for an internal combustion engine, said controller comprising:

changing means for changing a target air-fuel ratio corresponding to an engine running state;

control means for controlling an opening degree of a purge valve, during discharge of fuel vapor that has been adsorbed in a canister to an air-intake side of an internal combustion engine in correspondence with a differing air-fuel ratio;

computing means for computing purge concentration to calculate an effect of purging by said control means with respect to a predetermined air-fuel ratio; and correcting means for correcting a fuel-injection quantity supplied to said internal combustion engine on a basis of a purge concentration calculated by said computing means.

18. An air-fuel ratio controller f or an internal combustion engine according to claim 17, further comprising:

purge flow quantity computing means for computing a fuel-vapor quantity expelled from said intake-air side, wherein said correcting means computes a fuel-injection correction quantity on a basis of a purge concentration with respect to said predetermined air-fuel ratio, a fuel-vapor quantity computed by said purge-flow quantity computing means, and a present air-fuel ratio.

19. An air-fuel ratio controller for an internal combustion engine according to claim 18, wherein said purge-flow quantity computing means computes a fuel-vapor quantity expelled to said air-intake side on a basis of a fuel-vapor quantity expelled to said air-intake side when said purge valve is fully open, and a present opening degree of said purge valve.

20. A control system for an internal combustion engine, said control system comprising:

a fuel adsorber connected between a fuel tank and the engine that adsorbs fuel vapor from the fuel tank;

a purge valve that is connected between the fuel adsorber and the engine that selectively opens to discharge the adsorbed fuel vapor from the fuel adsorber to the engine;

a purge controller that controls selective opening of the purge valve during discharge of the adsorbed fuel vapor to the engine to adjust an engine fuel-injection quantity based on a purge control parameter, that controls an air-fuel ratio in correspondence with a running state of the engine, and that corrects the purge control parameter as a function of the controlled air-fuel ratio.

21. A control system for an internal combustion engine, said control system comprising:

a fuel adsorber connected between a fuel tank and the engine that adsorbs fuel vapor from the fuel tank;

a purge valve that is connected between the fuel adsorber and the engine that selectively opens to discharge the adsorbed fuel vapor from the fuel adsorber to the engine;

a controller that changes a target air-fuel ratio corresponding to an engine running state and, that controls the selective opening of the purge valve during discharge of the adsorbed fuel vapor as a function of a differing air-fuel ratio, that computes a purge concentration to determine an effect of purging as a function of a predetermined air-fuel ratio, and that corrects a fuel-injection quantity supplied to the engine as a function of the purge concentration.

22. A method for controlling an air-fuel ratio in an internal combustion engine, said method comprising the steps of:

controlling discharge of adsorbed fuel vapor to the engine for fuel-injection quantity correction based on a discharge control parameter;

continuously adjusting an air-fuel ratio in correspondence with a running state of the engine; and correcting the discharge control parameter that is utilized during the step of controlling discharge based on the air-fuel ratio resulting from the step of continuously adjusting an air-fuel ratio.

23. A method for controlling an air-fuel ratio for an internal combustion engine, said method comprising the steps of:

controlling purging of adsorbed fuel vapor to the engine as a function of a changing air-fuel ratio;

computing a purge concentration to calculate an effect of the step of controlling purging with respect to a predetermined air-fuel ratio; and correcting a fuel-injection quantity supplied to the engine based on the computed purge concentration.

* * * * *